US011828220B1

(12) United States Patent
Zhang et al.

(10) Patent No.: US 11,828,220 B1
(45) Date of Patent: Nov. 28, 2023

(54) ACTIVE PRE-CHAMBER JET-ASSISTED H2 MULTI-MODE COMBUSTION

(71) Applicant: SAUDI ARABIAN OIL COMPANY, Dhahran (SA)

(72) Inventors: Yu Zhang, Novi, MI (US); Nayan Engineer, Canton, MI (US); David Cleary, West Bloomfield, MI (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/148,842

(22) Filed: Dec. 30, 2022

(51) Int. Cl.
*F02B 19/14* (2006.01)
*F02B 19/12* (2006.01)
*F02B 43/10* (2006.01)

(52) U.S. Cl.
CPC ..... *F02B 19/14* (2013.01); *F02B 19/12* (2013.01); *F02B 43/10* (2013.01)

(58) Field of Classification Search
CPC ..... F02B 19/14; F02B 19/12; F02B 43/10
USPC ..... 123/259
See application file for complete search history.

(56) References Cited

U.S. PATENT DOCUMENTS 6,779,337 B2 8/2004 Tang et al.
7,059,114 B2 6/2006 Tang et al.
2021/0324785 A1* 10/2021 Conway ..... H01T 13/32

FOREIGN PATENT DOCUMENTS

CN 102425483 A * 4/2012
GB 2584735 A * 12/2020 ..... F02B 19/10
JP 2017072031 A * 4/2017

OTHER PUBLICATIONS

JP201772031A (Ryu et al.) (Apr. 13, 2017) (Machine Translation) (Year: 2017).*
CN102425483A (Zhang et al.) (Apr. 25, 2012) (Machine Translation) (Year: 2012).*
Boretti et al., "Experimental and numerical study of a hydrogen fuelled IC engine fitted with the hydrogen assisted jet ignition system." 16th Australasian Fluid Mechanics Conference, 2007, 6 pages.
Boretti, "Simulations of multi combustion modes hydrogen engines for heavy duty trucks." International Journal of Engineering and Technology Innovation, 2012, 18 pages.
(Continued)

*Primary Examiner* — Mahmoud Gimie
(74) *Attorney, Agent, or Firm* — Osha Bergman Watanabe & Burton LLP

(57) ABSTRACT

The present disclosure is directed toward an engine system and a multi-mode combustion method for an internal combustion engine using hydrogen as a fuel. The engine system comprises a combustion system including a step-lipped piston bowl, a cover opposing the piston bowl, a hydrogen direct injector, and a radially asymmetrical pre-chamber partially opposite the lip of the piston bowl. The multi-mode combustion method includes injecting hydrogen and air a first time into the combustion system through the hydrogen direct injector, and jet igniting the fuel-air mixture in the combustion system. The injecting occurs during an intake stroke at low loads, and during a compression stroke at medium and high loads, Injecting hydrogen and air into the combustion system a second time via the hydrogen direct injector occurs either during or after jet-igniting, the hydrogen and air being at least partially ignited by compression.

13 Claims, 5 Drawing Sheets

(56) References Cited

OTHER PUBLICATIONS

Koch et al., "Engine Adaption from Diesel to H2 HP-EGR Lean Combustion Concept," MTZ, 2020, 9 pages.
Sebastian Verhelst and Thomas Wallner, "Hydrogen-fueled internal combustion engines." Progress in energy and combustion science, 2009, 133 pages.
Stepien, "A comprehensive overview of hydrogen-fueled internal combustion engines: achievements and future challenges." Energies, 2021, 26 pages.
Yip et al. , "A Review of Hydrogen Direct Injection for Internal Combustion Engines: Towards Carbon-Free Combustion," Applied Science, 2019, 30 pages.

* cited by examiner

ACTIVE PRE-CHAMBER JET-ASSISTED H2 MULTI-MODE COMBUSTION

BACKGROUND

The transport industry is facing rising regulatory demand towards zero criteria pollutants and drastically reduced CO2 emissions. An increasing number of countries around the world pledge to be carbon-neutral by the mid-2020s. Due to the carbonless nature, hydrogen (H2) has become an attractive energy source for future propulsion system technology development.

Compared to H2 fuel cells (H2-FC), hydrogen internal combustion engines (H2-ICEs) are of markedly lower cost and do not require high H2 purity. In addition, the existing engine architectures and production lines can be persevered and utilized, thereby further lowering the barrier for market entry. Therefore, H2-ICEs can play an important and pragmatic role in the decarbonization process. Meanwhile, despite the promising strategic potential, there are technical areas that need to be sufficiently developed to make H2-ICEs a viable alternative to modern heavy-duty diesel engines. Considering H2's high burning velocity and low minimum ignition energy combined with the large cylinder bore size and low speed operation environment for heavy-duty commercial engines, the maximum engine specific torque and power for homogeneous, spark-ignited, heavy-duty H2-ICEs are typically limited due to the concerns over pre-ignition, excessive pressure rise rate, and knock. The allowable compression ratio (CR) is also constrained because of these concerns and thus hinders H2-ICEs from achieving diesel-like fuel efficiency. Therefore, developing an engine system concept that can satisfactorily address the abovementioned challenges is of vital importance to enhance the competitiveness of H2-ICE in the commercial transport sector.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an engine system comprising a combustion system comprising a piston bowl, a cover opposing the piston bowl, a hydrogen direct injector that is mounted in the center of the cover, and a pre-chamber comprising one or more openings into the combustion system, wherein the piston bowl is step-lipped, wherein the pre-chamber is mounted in the cover, wherein the pre-chamber is radially asymmetrical, and wherein a portion of the pre-chamber is opposite the lip of the piston bowl.

In another aspect, embodiments disclosed herein relate to a method comprising injecting hydrogen and air a first time into the combustion system through the hydrogen direct injector, and jet igniting the fuel-air mixture in the combustion system. At low loads the injecting occurs during an intake stroke. At medium loads and at high loads, the injecting the first time occurs during a compression stroke, and injecting hydrogen and air into the combustion system a second time via the hydrogen direct injector either during or after the jet-igniting. At medium loads and at high loads, the hydrogen and air in the combustion system is at least partially ignited by compression of the hydrogen and air.

In a further aspect, embodiments disclosed herein relate to a combustion apparatus comprising a piston bowl, a cover opposing the piston bowl forming a combustion chamber, a hydrogen direct injector that is mounted in the center of the cover, and a pre-chamber comprising one or more openings into the combustion chamber. The piston bowl is step-lipped. The pre-chamber is radially asymmetrical and is mounted in the cover. A portion of the pre-chamber is opposite the lip of the piston bowl.

Other aspects and advantages of the claimed subject matter will be apparent from the following description and the appended claims.

DETAILED DESCRIPTION

In one aspect, embodiments disclosed herein relate to an internal combustion engine (ICE) configuration using hydrogen (H2) as a fuel along with a corresponding multi-mode combustion.

According to one or more embodiments, a H2 combustion engine may comprise a turbocharger, a piston bowl that may have a step-lipped design, a centrally-mounted H2 direct injector, and a side-mounted active hydrogen pre-chamber. The engine system may be configured to have a geometric compression ratio (CR) of at least 16.

The turbocharger may be single-stage or multi-stage. The turbocharger may be a variable geometry turbocharger (VGT) and may be targeted to deliver adequate boost and exhaust gas recirculation (EGR) route.

The cam profile may be Millerized in one or more embodiments with late intake valve closing (LIVC).

Figure 1A:
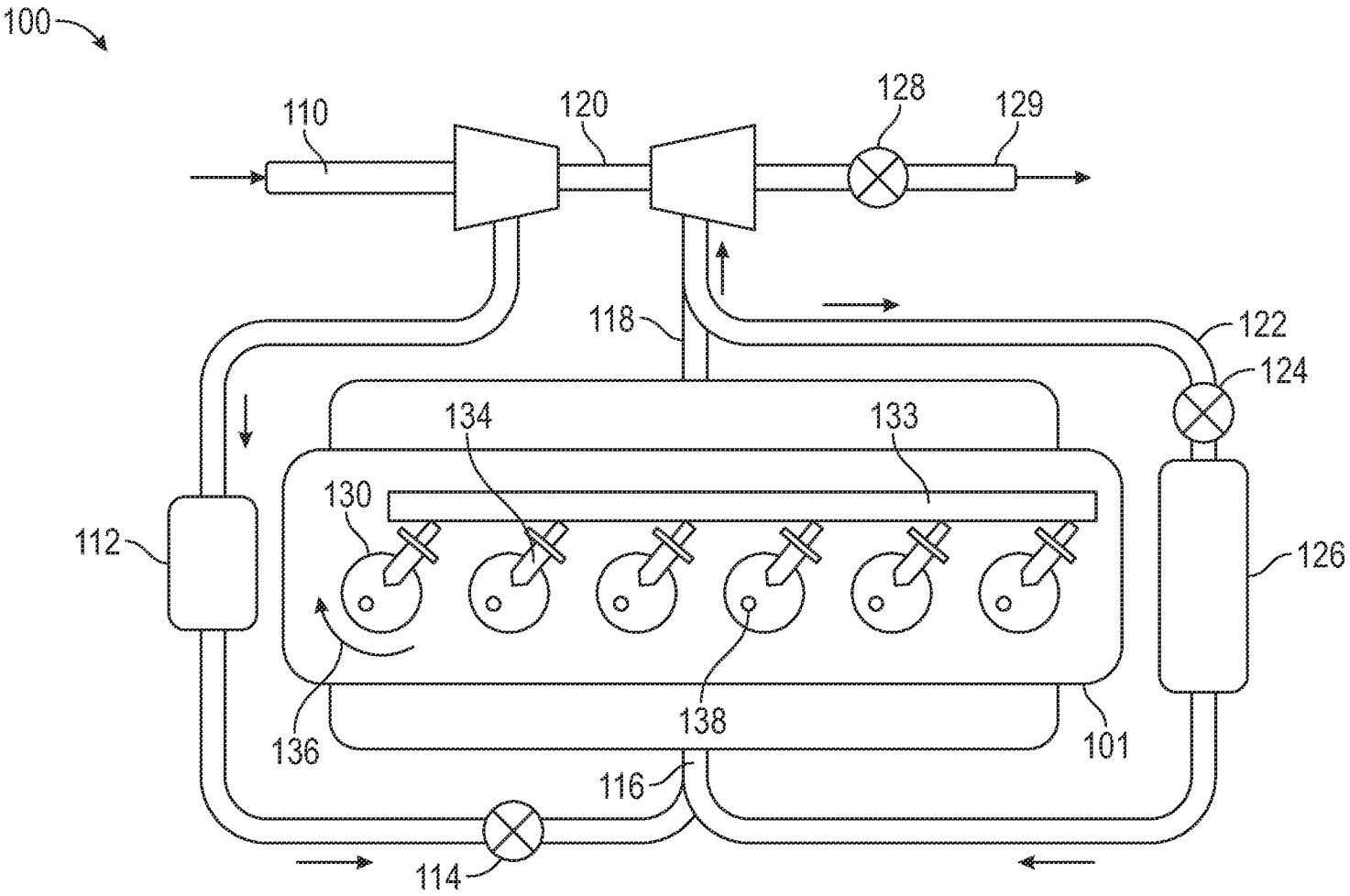
FIG. 1A is a depiction of an example engine system 100, according to one or more embodiments.

FIG. 1A is a depiction of an example engine system 100, according to one or more embodiments. In these embodiments, an air stream 110 passes through a turbocharger 120, a charge air cooler 112, and an intake air throttle 114. The air stream 110 is combined with the exhaust gas recirculation (EGR) stream 122 at the intake 116, and the intake 116 enters the engine 101. The engine 101 comprises combustion systems 130. Each combustion system 130 comprises a direct injector 134 and a pre-chamber 138. The combustion system 130 produces a swirl motion 136 with a swirl ratio of about 1.0. Exhaust gas stream 118 splits from the EGR stream 122, becoming the exiting exhaust gas stream 129, before entering the turbocharger 120. From there, the exiting exhaust gas stream 129 passes through the back pressure valve 128 and out of the system. The EGR stream 122 passes through the EGR valve 124 and the EGR cooler 126 before combining with the air stream 110 at the intake 116.

In engine system 100, according to one or more embodiments, air in an air stream 110 passes through a turbocharger 120, where it is compressed. The air is then cooled in a charge air cooler 112 and passes through intake air throttle 114. The air stream 110 is combined with the exhaust gas recirculation (EGR) stream 122 at the intake 116, and the intake 116 enters the engine 101. Combustion of hydrogen occurs in the combustion systems 130. Here, hydrogen from the hydrogen fuel rail 133 is injected into the combustion system 130 via a direct injector 134 and the fuel mixture is ignited using a pre-chamber 138. The combustion system 130 produces a swirl motion 136 with a swirl ratio of about 1.0. Exhaust from the combustion systems moves out of the engine 101 in the exhaust gas stream 118. The EGR stream branches from the exhaust gas stream 118 and returns back to the intake 116. Exhaust gas in the EGR stream 122 passes through the EGR valve 124 and the EGR cooler 126 before combining with the air stream 110 at the intake 116. The remaining exhaust in the exiting exhaust gas stream 129 moves through the turbocharger 120, where it rotates the turbocharger 120, and provides it with the energy to compress the air stream 110.

Figure 1C:
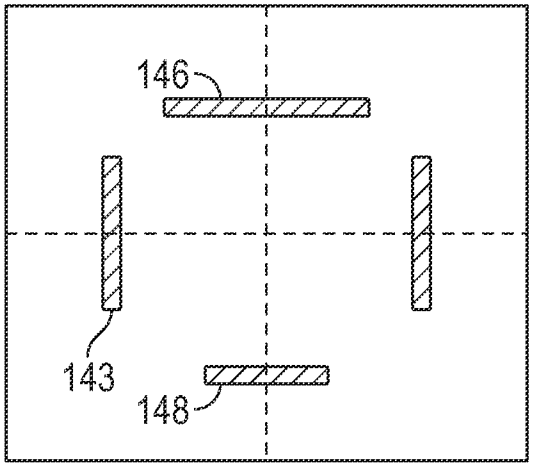
FIG. 1C is a configuration of openings in a pre-chamber according to one or more embodiments.
Figure 1B:
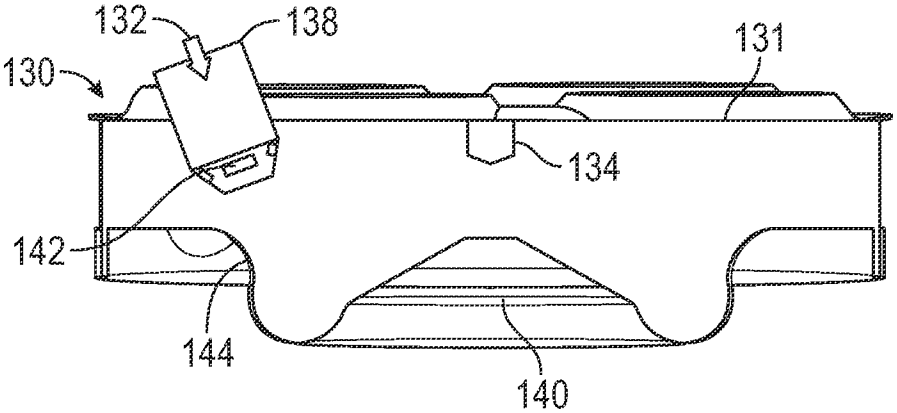
FIG. 1B is a configuration of a combustion system 130 of one or more embodiments.

FIG. 1B is a configuration of a combustion system 130 of one or more embodiments. A piston 140 and a piston bowl 144 is located at one end of the combustion system 130, with a cover 131 opposing the piston bowl 144. A hydrogen direct injector 134 is mounted in the center of the cover 131. A pre-chamber 138 fed by hydrogen 132 is also mounted in the cover 131 and comprises one or more openings 142 into the combustion system 130. A portion of the pre-chamber 138 is located opposite a lip of the piston bowl 144, which may have a step-lipped design. Here, the phrase step-lipped refers to the inclusion of a step around the piston bowl.

FIG. 1C is a configuration of a layout of slit openings in a pre-chamber according to one or more embodiments. A pre-chamber opening layout may be radially asymmetrical. The slits may be asymmetrical and may have different sizes, be arranged in an asymmetrical fashion, or both. The pre-chamber may have one smaller slit 148, one larger slit 146, and two intermediate slits 143. The smaller slit 148 may be distal from the center of the combustion system as compared to the larger slit 146.

The pre-chamber may have one or more openings into the combustion system. Openings in the pre-chamber may be of any shape or configuration known to those skilled in the art. The openings may have an asymmetrical configuration. In one or more embodiments, the openings may be rectangular or slit-shaped. The openings may include at least one smaller slit and at least one larger slit and may also include one or more intermediate-sized slits each with a length between that of the smaller slit and the larger slit. The ratio of the length of the smaller slit to the length of the larger slit may be in a range with a minimum of any of 20%, 40%, and 50%, and a maximum value of any of 60%, 70%, 85%, and 95%.

A swirl ratio is defined as the angular velocity of fluid in the cylinder normalized by the engine speed. Swirl in a cylinder in an engine may improve mixing of fuel and air. In one or more embodiments, the swirl ratio may be in a range of between 0.5 and 1.5. The swirl ratio may be in a range with a minimum value of any of 0.5, 0.6, 0.7, 0.8, or 0.9, and a maximum value of any of 1.1, 1.2, 1.3, 1.4, or 1.5.

A pre-chamber according to some embodiments may include an ignition source, and may be connected to an oxygen source, such as air, and a hydrogen source, such as a hydrogen injector. The pre-chamber provides ignition in the combustion system. Hydrogen may be introduced into the pre-chamber. A spark plug may ignite the hydrogen and generate a jet that then exits the pre-chamber openings and enters the combustion system, igniting the fuel in the combustion system. As the initiating and assisting ignition source, the active pre-chamber may have appropriate jet penetration and ignition strength to help robustly extend the lean limit and dilution tolerance. The jet penetration and its ignition impact may be contained locally without causing undesired interference with the main combustion process that is intended to be driven by the DI fuel stratification. In addition, as the pre-chamber may be side-mounted, both the size and the angle of the slits may be customized asymmetrically based on the spray-bowl interaction and the swirl motion.

Figure 2B:
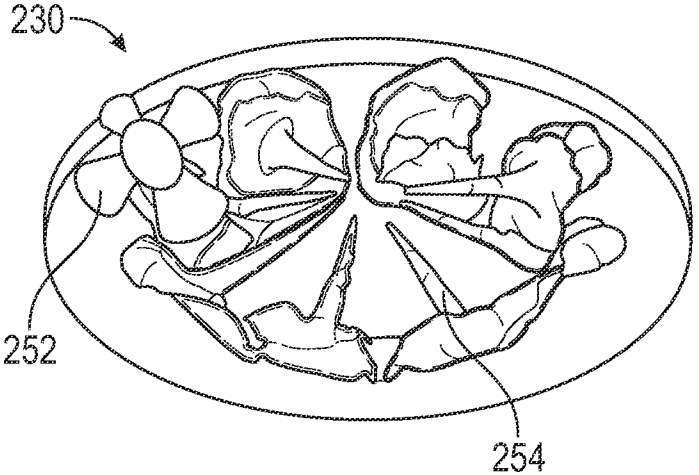
FIG. 2B is a depiction of a simulation of hydrogen jets in a combustion system 230 according to some embodiments.
Figure 2A:
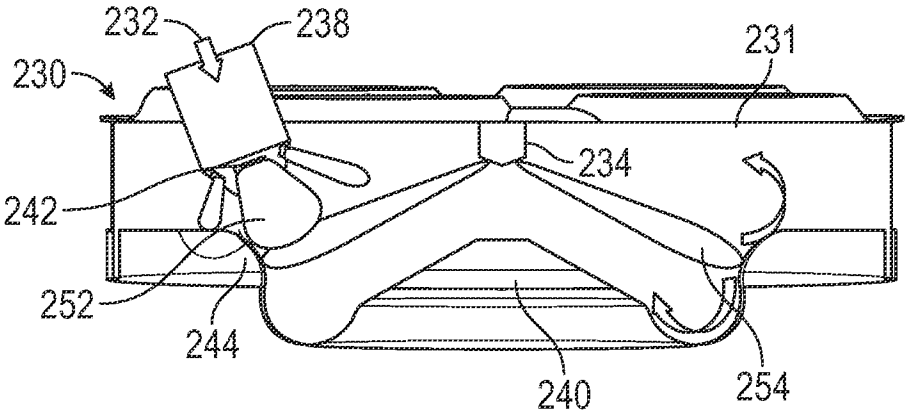
FIG. 2A is a configuration of a combustion system 230 under operation in one or more embodiments.

FIG. 2A is a configuration of a combustion system 230 under operation in one or more embodiments. A piston 240 and a piston bowl 244 is located at one end of the combustion system 230, with a cover 231 opposing the piston bowl 244. A hydrogen direct injector 234 is mounted in the center of the cover 231. A pre-chamber 238 fed by hydrogen 232 is also mounted in the cover 231 and comprises one or more openings 242 into the combustion system 230. A portion of the pre-chamber 238 is located opposite a lip of the piston bowl 244, which may have a step-lipped design. Ignition may be initiated via jets 252 of ignited hydrogen from the pre-chamber 238. Fuel injection may be initiated from the fuel injector 234 and may produce jets 254 of hydrogen penetrating the combustion system, targeting the lip of the piston bowl 244.

FIG. 2B is a depiction of a simulation of hydrogen jets in a combustion system 230 according to some embodiments. The direct injector includes a number of openings that produce jets of hydrogen 254 targeting the lip of the piston bowl and ignited by the ignited jets 252 from the prechamber.

The combustion mode may change as the load on the engine increases. In order to account for the different combustion modes, there may be changes in injection strategy, injection pressure, the use of exhaust gas recirculation, and the air to fuel ratio, k, to account for and improve engine operation under different loads.

The definition of "low", "medium", and "high" loads may vary across different embodiments. In some embodiments, the boundary between "low" and "medium" loads may be in a range with a minimum value of any of 25%, 35%, 40% or 45% and a maximum value of any of 55%, 60%, or 65% of the overall output capacity, with any minimum value being combinable with any maximum value. The boundary between "medium" loads and "high" loads may be between 50% and 100% of the overall output capacity, according to some embodiments.

Figure 3A:
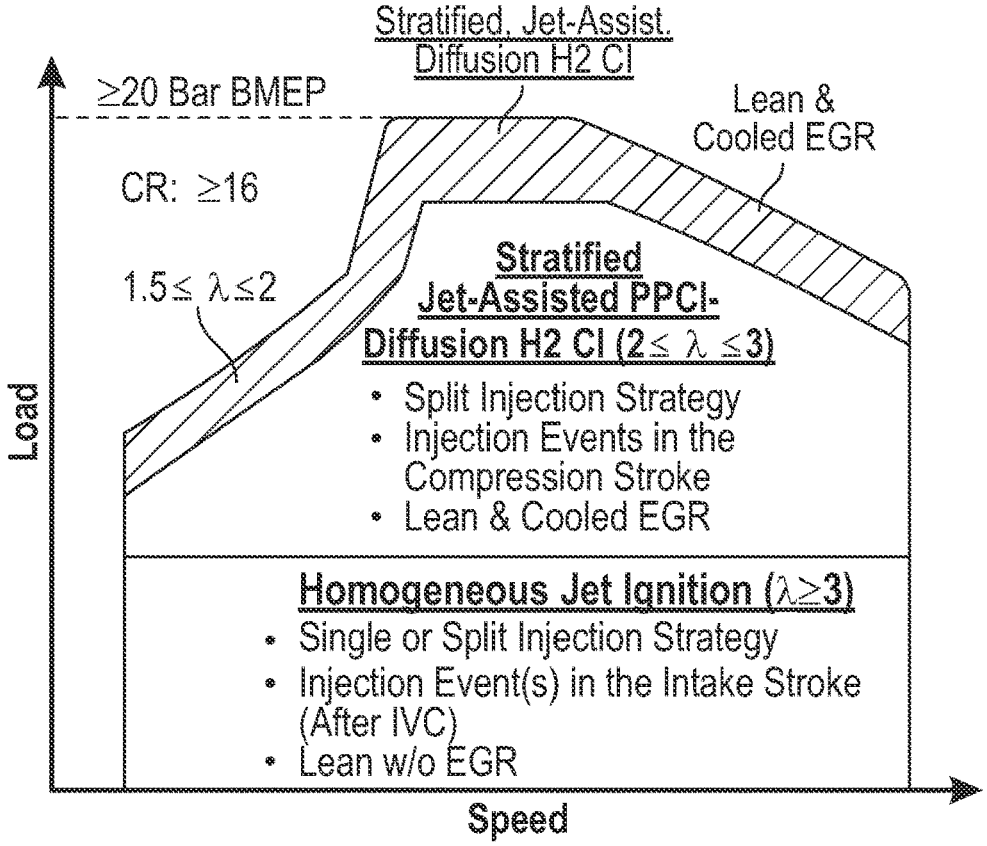
FIG. 3A is a depiction of load and engine RPM, according to one or more embodiments.

FIG. 3A is a plot of load and engine RPM, according to one or more embodiments. At low loads, a single or split injection strategy may be employed with injection event or events occurring in the intake stroke after intake valve closing. Ignition may occur via homogeneous jet ignition of the fuel-air mixture. At medium loads, a split injection strategy may be employed with injection events in the compression stroke. The combustion mode may be stratified jet-assisted PPCI-Diffusion combustion. Lean and cooled exhaust gas recirculation may be used. Under high loads, a split injection strategy may be employed with injection events in the compression stroke. Lean and cooled exhaust gas recirculation may be used. Ignition may occur via stratified, jet-assisted diffusion hydrogen compression ignition.

The transition between low and medium load modes may be abrupt. At low loads, a single injection occurs during the intake stroke. Upon transitioning to medium load, there are two injections that occur in the compression stroke. The transition from medium to high loadings is gradual, where the second injection is lengthened and the timing of the two injections changes gradually with loading.

Lambda (k), or the ratio of oxygen to hydrogen divided by the stoichiometric ratio required for combustion, may vary in the combustion system depending on the combustion mode, and may be greater than about 1.5 under any or all three load conditions. In low, medium, and high load modes, in some embodiments, $\lambda$ may decrease as the power load increases. At low loads, the air/fuel mixture may be lean and $\lambda$ may be greater than about 3. In some embodiments, at low loads, $\lambda$ may be in a range of 3 to 5 and may have a minimum value of any of about 3, 3.3, or 3.5, and a maximum value of any of about 4.5, 4.8, or 5, with any minimum value being combinable with any maximum value.

At medium loads, $\lambda$ may be in a range of between about 2.0 and about 3.5. In one or more embodiments, at medium loads, $\lambda$ may be in a range with a minimum value of any of about 2, 2.2, or 2.5 and a maximum value of any of about 3, 3.2, or 3.5, with any minimum value being combinable with any maximum value.

At high loads, $\lambda$ may be in a range of between about 1.2 and about 2.0. In one or more embodiments, at high loads, $\lambda$ may be in a range with a minimum value of any of about 1.2, 1.3, or 1.4, and a maximum value of any of about 1.8, 1.9, or 2.0, with any minimum value being combinable with any maximum value.

The exhaust gas recirculation (EGR) stream may be introduced into the intake under any load conditions. However, in one or more embodiments, the exhaust gas recirculation stream may be introduced under medium and high load conditions, as it may not be needed at low loads. $NO_x$ often requires high temperatures to form. EGR may reduce the production of $NO_x$ as it reduces the amount of oxygen in the combustion system, lowering the amount of hydrogen that can be consumed. The reduction in the oxygen in the combustion system reduces the amount of oxygen available for the formation of $NO_x$. In addition, the gas from the EGR stream has a large heat capacity, lowering the temperature in the combustion system.

At low loads, low combustion temperature may be achieved through the use of ultra-lean operation, meaning that EGR may not be needed to reduce temperature. At medium-to-high load, ultra-lean operation places high demand on the turbocharger. Therefore, the use of EGR becomes a more effective and practical means to lower combustion temperature when compared with the turbocharger under medium-to-high loads.

The engine system concept and a tailored operating strategy may collectively enable a jet-assisted, H2 multi-mode combustion strategy in one or more embodiments. At low loads, a homogeneous, ultra-lean ($\lambda \geq 3$), jet ignition strategy may be employed by directly injecting H2 after the intake valve closing (IVC) during the intake stroke. The combustion mode may be via homogeneous jet ignition via the pre-chamber.

At medium loads, the injection strategy may migrate from a single injection event during the intake stroke to a split injection strategy with both injection events occurring in the compression stroke. The first injection may occur at −40 to −30 degrees after top dead center (°aTDC), targeting the bowl rim to prepare an initial phase of lightly stratified fuel-air mixture formation. Top dead center pertains to the position of the crank when the piston is at the top of its stroke and the combustion chamber is at its smallest. Subsequently, the ignition event may occur through active pre-chamber jet ignition assisting a PPCI combustion process. PPCI, or partially-premixed compression ignition, may occur where partially mixed fuel and air ignite due to a compression-initiated temperature increase. The ignition may occur near TDC. The second injection then takes place, generating stronger fuel stratification or non-homogeneous fuel distribution and thus providing effective control over both the combustion duration and the combustion noise.

For high load operation, both injection events occur later in the compression stroke due to increased charge thermal reactivity. As a result, the combustion process can be characterized into three phases, including jet assistance, PPCI combustion, and diffusion combustion. Diffusion combustion refers to the combustion rate being controlled by the ability of fuel and air to mix. The first two phases may be designed purposely to build a proper thermal environment that facilitates robust control of the main ignition delay, while the second fuel injection occurs prior to TDC (Top Dead Center) targeting the lip in the bowl as depicted in FIG. 2A to produce a fast diffusion combustion process by achieving well-organized late-stage air utilization.

Figure 3B:
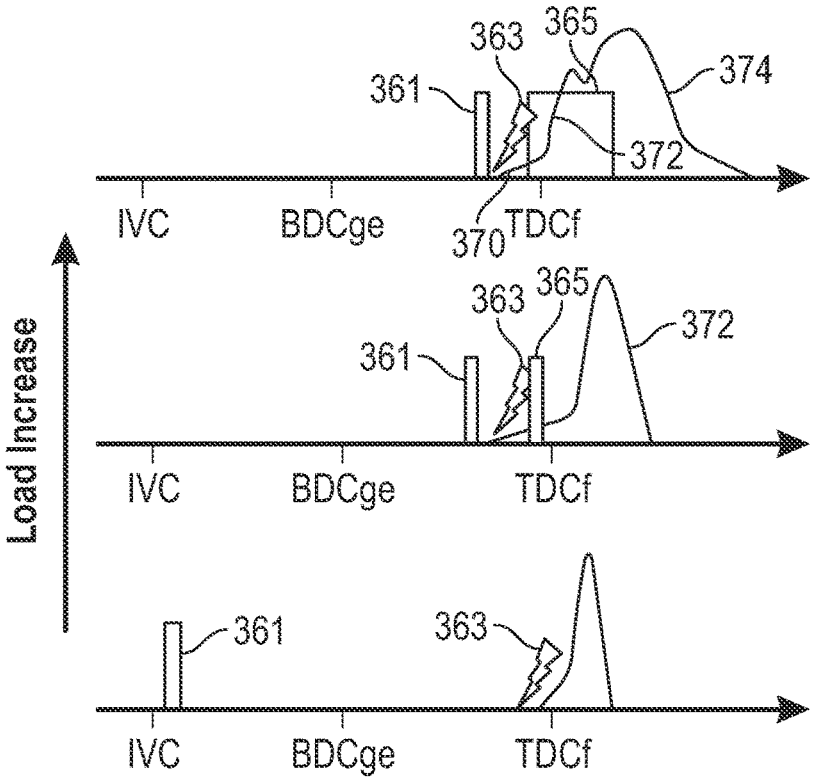
FIG. 3B is a depiction of engine timing at different loads, according to one or more embodiments.

FIG. 3B is a depiction of engine timing at different loads, according to one or more embodiments. Under all loads, the ignition 363 occurs around TDC. In these embodiments, at low loads, a single injection is used. The first injection 1-361 occurs just after IVC. At medium loads, the first injection 361 occurs during the compression stroke, and may be at −40 to −30 degrees after top dead center (°aTDC). A PPCI combustion process 372 is initiated. The second injection 365 occurs after ignition. At high loads, the first injection 361 and second injection 365 occur later in the compression stroke than they do under medium loads due to increased charge thermal reactivity. The second injection occurs near TDC. The combustion process has three phases: jet assistance 370, PPCI combustion 372, and diffusion combustion 374.

Various aspects of an example fuel and air-handling operating strategy for an engine according to one or more embodiments can be seen in FIG. 4A-4F.

Figure 4A:
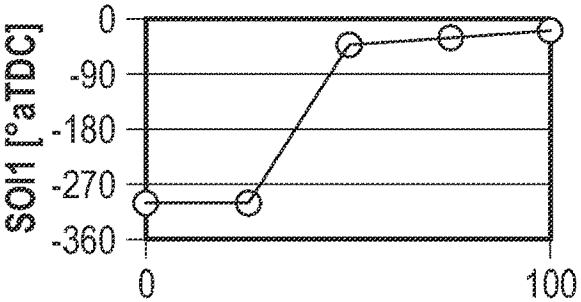
FIG. 4A is a depiction of timing for the first injection event in °aTDC vs % load in an example fuel and air-handling operating strategy, according to one or more embodiments.

FIG. 4A is a depiction of timing for the first injection event in °aTDC vs % load in an example fuel and air-handling operating strategy, according to one or more embodiments. At low loads the first injection SOI1 occurs near −300 °aTDC, shifting to −40 to −30 °aTDC at medium loads. As the loading increases to high loads, the timing of the first injection shifts toward TDC.

Figure 4B:
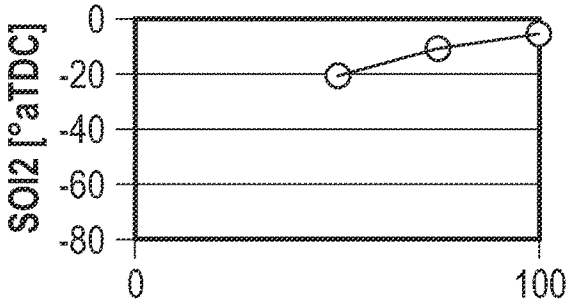
FIG. 4B is a depiction of timing for the second injection event in °aTDC vs % load in an example fuel and air-handling operating strategy, according to some embodiments.

FIG. 4B is a depiction of timing for the second injection event in °aTDC vs % load in an example fuel and air-handling operating strategy, according to some embodiments. In these embodiments, there is no second injection at low loads. At medium loads, the second injection begins at −20 °aTDC, shifting closer to TDC as the loading increases to high loads.

Figure 4C:
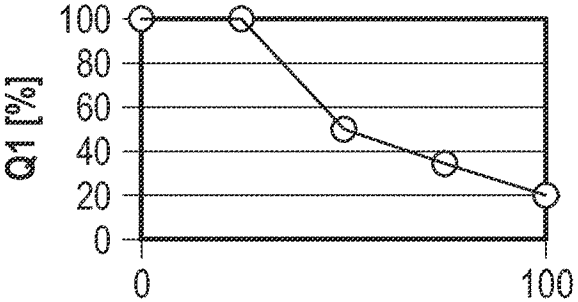
FIG. 4C is a depiction of the fraction of the fuel quantity (Q1 (%)) used in the first injection event vs % load in an example fuel and air-handling operating strategy, according to one or more embodiments.

As the loading increases, the fuel quantity from the first injection decreases starting at medium loads and continues to decrease at high loads. FIG. 4C is a depiction of the fraction of the fuel quantity (Q1 (%)) used in the first injection event vs % load in an example fuel and air-handling operating strategy, according to one or more embodiments. Q1 decreases from 100% to about 20% with the loading increase from low to high loads.

Figure 4D:
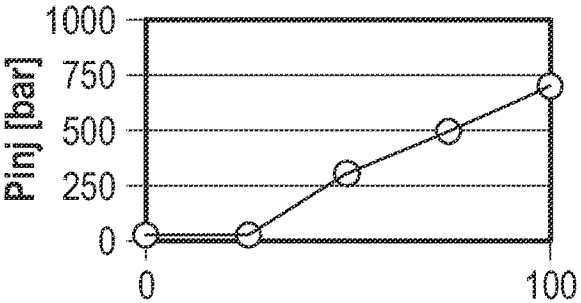
FIG. 4D is a depiction of the fuel injection pressure vs % load in an example fuel and air-handling operating strategy some embodiments.
Figure 4E:
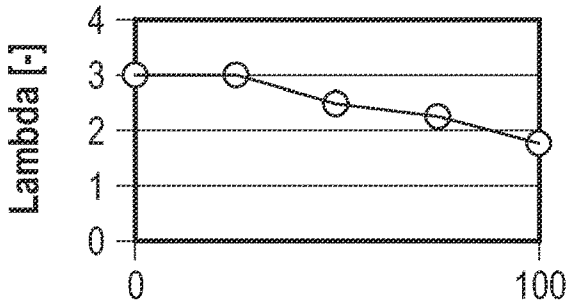
FIG. 4E is a depiction of λ vs % load in an example fuel and air-handling operating strategy, according to one or more embodiments.

FIG. 4D is a depiction of the fuel injection pressure vs % load in an example fuel and air-handling operating strategy some embodiments. Here, the fuel injection pressure (Pinj) progressively increases with load as the in-cylinder fuel stratification becomes heavier FIG. 4E is a depiction of λ vs % load in an example fuel and air-handling operating strategy, according to one or more embodiments. The fuel mixture is leaner (λ≥3) under low-load operation and λ then decreases as load increases. In one or more embodiments, the target λ is greater than or equal to about 1.5 across the full load range.

Figure 4F:
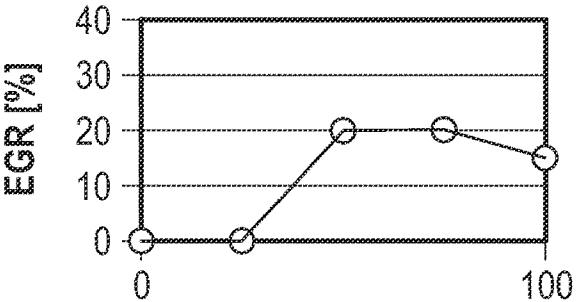
FIG. 4F is a depiction of % exhaust gas recirculation vs. % load in an example fuel and air-handling operating strategy, according to some embodiments.

FIG. 4F is a depiction of % exhaust gas recirculation vs. % load in an example fuel and air-handling operating strategy, according to some embodiments. EGR may not be needed at low loads. As engine load increases, the required EGR fraction may increase. In the embodiments of FIG. 4F, EGR fraction may increase to between 15-20%. EGR increases under medium loading and decreases at high loads. At high loads, in accordance with one or more embodiments, driving EGR while achieving lean operation becomes more challenging for the turbocharger at high loads. EGR fraction may therefore be reduced to meet the desired λ at high loads.

As described above, embodiments herein provide for an active-prechamber jet-assisted, H2 multi-mode engine system concept and the operating strategy described for embodiments herein offers a viable path to achieve diesel-like or better engine specific torque (≥20 bar maximum BMEP) and maximum BTE (≥46%). The uniqueness of embodiments herein may include one or more of the following advantages, including a multi-mode H2 combustion concept having a tailored combustion system design paired with a customized engine operating strategy, encompassing homogeneous and ultra-lean jet ignition at low loads (λ≥3), jet-assisted PPCI combustion at medium loads (2≤λ≤3), and jet-assisted PPCI-diffusion combustion at high loads (1.5≤λ≤2). Embodiments herein further provide for a combustion system that includes a centrally-mounted high pressure H2 DI (≥300 bar), side-mounted, H2-fueled active pre-chamber, step-lipped piston bowl design, ≥16 geometric CR with LIVC, and −1.0 swirl ratio. Further, embodiments herein provide for an asymmetric, slit-type, pre-chamber jet pattern to effectively achieve desired jet penetration and ignition strengthen without interfering with the main combustion process that is driven by the DI fuel stratification. These and other features described herein may provide for effective and efficient H2 engine systems.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. An engine system comprising:

a combustion system comprising a piston bowl, a cover opposing the piston bowl, a hydrogen direct injector that is mounted in the center of the cover, and a pre-chamber comprising one or more openings into the combustion system, wherein the piston bowl is step-lipped, wherein the pre-chamber is mounted in the cover, wherein the pre-chamber is radially asymmetrical, and wherein a portion of the pre-chamber is opposite the lip of the piston bowl;

wherein the one or more openings into the combustion system comprises at least one smaller slit and at least one larger slit.

2. The engine system of claim 1, wherein the combustion system produces a swirl ratio in a range of between 0.5 and 1.5.

3. The engine system of claim 1, wherein a length of the at least one smaller slit is in a range of from 20% to 95% of a length of the at least one larger slit.

4. The engine system of claim 1, wherein the at least one smaller slit is distal from the center of the combustion system as compared to the at least one larger slit.

5. The engine system of claim 1, wherein the one or more openings further comprises at least one intermediate slit, wherein a length of the at least one intermediate slit is greater than the length of the at least one smaller slit and less than the length of the at least one larger slit.

6. The engine system of claim 1, wherein a geometric compression ratio of the engine system is at 16 or greater.

7. The engine system of claim 1, further comprising a turbocharger including an exhaust gas recirculation stream.

8. A method comprising:

injecting hydrogen and air a first time into the combustion system of claim 1 through the hydrogen direct injector; and jet igniting the hydrogen and air in the combustion system, wherein at low loads the injecting occurs during an intake stroke, wherein at medium loads and at high loads, the injecting the first time occurs during a compression stroke, and injecting hydrogen and air into the combustion system a second time via the hydrogen direct injector occurs either during or after the jet-igniting, and wherein at medium loads and at high loads, the hydrogen and air injected in the combustion system is at least partially ignited by compression of the hydrogen and air.

9. The method of claim 8, wherein lambda (λ), the ratio of oxygen to hydrogen divided by the stoichiometric ratio required for combustion, in the combustion system is at least 3 at low loads.

10. The method of claim 8, wherein lambda (λ) in the combustion system is in a range of from 2 to 3 at medium loads.

11. The method of claim 8, wherein lambda (λ) in the combustion system is in a range of from 1.5 to 2 at high loads.

12. The method of claim 8, wherein the injecting the hydrogen and air the first time further comprises injecting an exhaust gas recirculation stream, and wherein the injecting the hydrogen and air the second time further comprises injecting the exhaust gas recirculation stream.

13. A combustion apparatus comprising:

a piston bowl;

a cover opposing the piston bowl forming a combustion chamber;

a hydrogen direct injector that is mounted in the center of the cover; and a pre-chamber comprising one or more openings into the combustion chamber, wherein the piston bowl is step-lipped, wherein the pre-chamber is mounted in the cover, wherein the pre-chamber is radially asymmetrical, and wherein a portion of the pre-chamber is opposite the lip of the piston bowl; and wherein the one or more openings into the combustion chamber comprises at least one smaller slit and at least one larger slit.

* * * * *